US009335065B2

(12) United States Patent
Farris et al.

(10) Patent No.: US 9,335,065 B2
(45) Date of Patent: May 10, 2016

(54) SYSTEM AND METHOD FOR ADJUSTING ANODE ROD GALVANIC CORROSION

(71) Applicant: General Electric Company, Schenectady, NY (US)

(72) Inventors: Brett Alan Farris, Louisville, KY (US); Michelle Diana Gross, Louisville, KY (US)

(73) Assignee: General Electric Company, Schenectady, NY (US)

( * ) Notice: Subject to any disclaimer, the term of this patent is extended or adjusted under 35 U.S.C. 154(b) by 387 days.

(21) Appl. No.: 13/870,236

(22) Filed: Apr. 25, 2013

(65) Prior Publication Data

US 2014/0321838 A1 Oct. 30, 2014

(51) Int. Cl.

| | |
|---|---|
| ***F24H 1/20*** | (2006.01) |
| ***H05B 3/78*** | (2006.01) |
| ***F24H 9/00*** | (2006.01) |
| ***F24H 9/20*** | (2006.01) |
| ***C23F 13/04*** | (2006.01) |
| ***C23F 13/06*** | (2006.01) |
| *F24H 1/18* | (2006.01) |

(52) U.S. Cl.

CPC ..... *F24H 9/0047* (2013.01); *C23F 13/04* (2013.01); *C23F 13/06* (2013.01); *F24H 9/2021* (2013.01); *C23F 2213/10* (2013.01); *F24H 1/185* (2013.01)

(58) Field of Classification Search

None

See application file for complete search history.

(56) References Cited

U.S. PATENT DOCUMENTS

| | | | | | |
|---|---|---|---|---|---|
| 2,486,871 | A * | 11/1949 | Osterheld | C23F 13/02 | 204/196.11 |
| 2,740,757 | A * | 4/1956 | Craver | C23F 13/02 | 204/196.11 |
| 2,982,714 | A * | 5/1961 | Sabins | C23F 13/04 | 204/196.03 |
| 2,987,461 | A * | 6/1961 | Sabins | C23F 13/04 | 204/196.02 |
| 3,049,479 | A * | 8/1962 | Preiser | C23F 13/02 | 204/196.3 |
| 3,714,004 | A * | 1/1973 | Riggs, Jr. | C23F 13/04 | 204/196.03 |
| 4,407,711 | A | 10/1983 | Baboian et al. | | |
| 4,559,017 | A * | 12/1985 | Cavil | C23F 13/02 | 204/196.3 |
| 4,713,158 | A * | 12/1987 | Lambert | G01R 17/02 | 204/196.03 |
| 4,786,383 | A * | 11/1988 | Houle | C23F 13/20 | 204/196.11 |
| 5,256,267 | A * | 10/1993 | Roden | C23F 13/10 | 122/13.01 |
| 7,017,251 | B1 | 3/2006 | Murphy | | |
| 7,857,949 | B2 * | 12/2010 | Closset | C23F 13/18 | 204/196.11 |
| 8,023,807 | B2 * | 9/2011 | Knoeppel | C23F 13/02 | 392/441 |
| 8,608,913 | B2 * | 12/2013 | Shim | C23F 13/04 | 204/196.1 |
| 2014/0218006 | A1 * | 8/2014 | Gross | G01N 17/02 | 324/71.4 |

* cited by examiner

*Primary Examiner* — Thor Campbell

(74) *Attorney, Agent, or Firm* — Dority & Manning, P.A.

(57) ABSTRACT

Systems and methods for adjusting anode rod galvanic corrosion are provided. An exemplary water heater includes a tank for holding a volume of water. The water heater also includes an anode rod extending into the water and electrically connected to an electrical ground such that a galvanic current flows from the anode rod to the electrical ground. The water heater includes at least one heating element configured to heat the water when energized. The water heater also includes a resistor configuration connected between the anode rod and the electrical ground such that the galvanic current flows through the resistor configuration. The resistor configuration provides a variable resistance.

18 Claims, 5 Drawing Sheets

SYSTEM AND METHOD FOR ADJUSTING ANODE ROD GALVANIC CORROSION

FIELD OF THE INVENTION

The present disclosure relates to systems and methods for adjusting galvanic corrosion. More particularly, the present disclosure relates to adjusting galvanic corrosion of an anode rod by adjusting a resistance provided by a resistor configuration in the path of a galvanic current flow.

BACKGROUND OF THE INVENTION

Most modern water heaters are constructed of a steel tank with a glass lining. Passive anode rods are a vital component to water heaters utilizing a steel tank or other forms of tanks susceptible to corrosion. An anode rod can act as a sacrificial anode that provides protection against tank corrosion. In particular, the anode rod acts as a sacrificial anode by way of galvanic corrosion.

As a result of the galvanic corrosion, a galvanic current can flow from the anode rod to a cathode to which the anode rod is electrically connected. The cathode is commonly the exterior of the tank connected to an earth ground. As the galvanic current is a result of the galvanic corrosion, greater corrosion results in greater galvanic current and vice versa.

An undesirable side effect of the use of an anode rod is an unpleasant smell, similar to rotten eggs. In particular, hydrogen can be produced as a byproduct of the galvanic reaction. The combined presence of hydrogen, sulfur, and sulfur-reducing bacteria can result in hydrogen sulfide. Such hydrogen sulfide can emit the unpleasant sulfurous smell, similar to rotten eggs, when water is used from the water heater. In particular, magnesium or magnesium alloy anode rods can result in a greater accumulation of hydrogen sulfide than aluminum or aluminum/zinc rods as the magnesium rods are more reactive (i.e. more susceptible to galvanic corrosion) under certain water conditions.

Therefore, a partial solution to the problem of sulfurous smell can be to replace a magnesium anode rod with an aluminum/zinc anode rod. However, for owners of a water heater that already have magnesium rods, replacement represents an undesirable additional monetary expense and loss of time. Further, for water with particular characteristics, such as softened water which can increase galvanic corrosion, even use of a less reactive aluminum/zinc rod does not solve the problem.

Powered anode rods which provide electricity into the tank can be used to completely replace sacrificial anodes. However, such powered rods are often quite expensive and much more complex for a homeowner to install and operate. Therefore, powered anode rods are generally undesirable for inclusion in standard model appliance production.

Another potential solution can be to periodically flush the water heater of all water, sanitize, and replace with fresh water. However, this again represents an undesirable use of time and further can result in leaks or even a complete release of water into a home if the proper order of flushing steps is not followed.

A more drastic solution to the problem of sulfurous smell is to remove the anode rod completely. While this may result in less undesirable smell, it also results in large amounts of tank corrosion. In particular, anode rods are essential to combating tank corrosion. Thus, complete removal of the anode rod will certainly lead to tank damage, drastically shortening the lifespan of the water heater.

As another exemplary problem, often the anode rod provided for a water heater is oversized, such that an excessively large magnitude of surface area is provided. Therefore, unnecessary galvanic action can occur which unnecessarily corrodes the anode rod and causes excess smell in the event sulfur is present.

Therefore, systems and methods for adjusting the rate of anode rod galvanic corrosion are desirable. In particular, systems and methods that adjust the rate of anode rod corrosion while maintaining a minimum rate such that the tank is properly protected from corrosion are desirable.

BRIEF DESCRIPTION OF THE INVENTION

Aspects and advantages of the invention will be set forth in part in the following description, or may be obvious from the description, or may be learned through practice of the invention.

One aspect of the present disclosure relates to a water heater. The water heater includes a tank for holding a volume of water. The water heater also includes an anode rod extending into the water and electrically connected to an electrical ground such that a galvanic current flows from the anode rod to the electrical ground. The water heater includes at least one heating element configured to heat the water when energized. The water heater also includes a resistor configuration connected between the anode rod and the electrical ground such that the galvanic current flows through the resistor configuration. The resistor configuration provides a variable resistance.

Another aspect of the present disclosure relates to a method for operating a water heater. The method includes connecting one or more resistors between an anode rod extending into a volume of water stored by the water heater and an electrical ground such that a galvanic current flows from the anode rod through the one or more resistors to the electrical ground. The method also includes adjusting a resistance provided by the one or more resistors such that the galvanic current is either increased or decreased.

Another aspect of the present disclosure relates to a method of operating a water heater. The method includes determining an optimal magnitude of a galvanic current flowing from an anode rod included in the water heater to an electrical ground. The method also includes connecting one or more resistors between the anode rod and the electrical ground such that the galvanic current flows through the one or more resistors. The method includes periodically adjusting an amount of resistance provided by the one or more resistors such that the galvanic current remains at the optimal magnitude.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
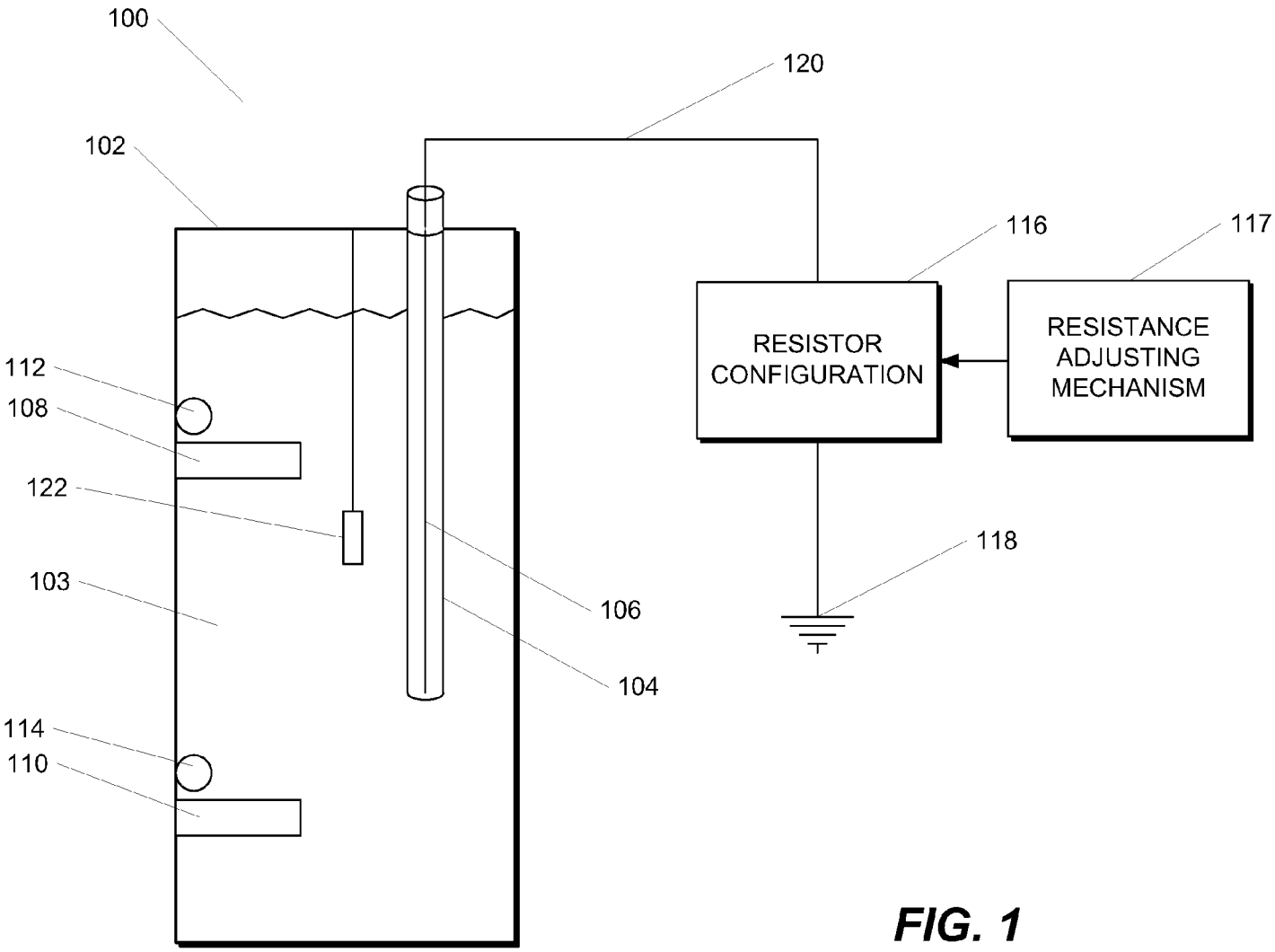
FIG. 1 depicts an exemplary water heating system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally the present disclosure is directed to systems and methods for adjusting the rate of galvanic corrosion. In particular, the present disclosure relates to adjusting the rate of galvanic corrosion of an anode rod by adjusting a resistance provided by a resistor configuration in the path of a galvanic current flow. Adjusting the resistance can provide for more or less galvanic current flow, therefore resulting in more or less galvanic corrosion of the anode rod.

An optimum level of anode rod corrosion can be obtained. For example, a rate of galvanic corrosion can be adjusted such that the tank of the water heater remains protected from corrosion while an unpleasant byproduct and smell can be reduced. Further, the life of the anode rod can be extended. The optimum level of anode rod corrosion can be maintained by periodically adjusting the rate of galvanic current to control the galvanic corrosion.

In one embodiment, the resistance provided by the resistor configuration can be adjusted by a user of the water heater. As an example, a single user-adjustable resistance adjusting mechanism can control current flow through the resistor configuration. As another example, a user interface can provide user instructions to a controller and the controller can adjust the resistance in accordance with the user instructions.

As yet another example, the resistor configuration can include a plurality of resistors in parallel. Each of the plurality of resistors can have an associated resistance adjusting mechanism that selectively allows or disallows the galvanic current to flow through the associated resistor. By manipulating the plurality of resistance adjusting mechanisms, a user can adjust the resistance provided by the resistor configuration.

In another embodiment, the resistance provided by the resistor configuration can be automatically adjusted by a controller based on one or more feedback signals. As an example, a probe can be positioned within the water heater and the probe can provide a feedback signal. For example, the feedback signal can describe one or more electrical attributes of the water stored in the water heater. Exemplary electrical attributes include, without limitation, a resistivity of the water, a conductivity of the water, or a voltage or potential from the probe to the tank (i.e. potential across the water).

The controller can implement one or more algorithms in order to adjust the resistance based on the received feedback signals. As an example, the controller can continually or periodically adjust resistance until the feedback signal matches a target value. As another example, the controller can calculate an anticipated measurement value associated with a candidate resistance. The controller can adjust the resistor configuration so as to provide the candidate resistance if the anticipated measurement value is desirable.

FIG. 1 depicts an exemplary water heating system 100 according to an exemplary embodiment of the present disclosure. Water heating system 100 can include tank 102 that holds a volume of water 103. An anode rod 104 can pass through an opening at the top of tank 102 and extend downwards into water 103. For example, anode rod 104 can be mounted to tank 102 at the opening where anode rod 104 enters tank 102. Anode rod 104 can be isolated from direct electrical connection to tank 102 by means of a insulated cap or liner placed between anode rod 104 and tank 102 at the place of mounting.

Figure 2:
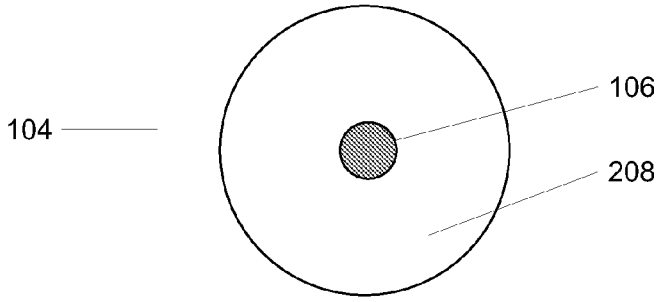
FIG. 2 depicts a cross-sectional view of an exemplary anode rod according to an exemplary embodiment of the present disclosure.

With reference to FIG. 2, a cross-sectional view of an exemplary anode rod 104 according to an exemplary embodiment of the present disclosure is depicted. Anode rod 104 can have a core 106 and an outer region 208. Core 106 can extend coaxially with outer region 208 throughout anode rod 104 such that core region 106 is coaxially surrounded by outer region 208. The configuration provided is exemplary in nature and other suitable configurations can be used.

Outer region 208 can be made of any suitable material. For example, outer region 208 can be made of magnesium, aluminum, or an aluminum-zinc alloy. Core 106 can be made of any conductive material. As an example, core 106 can be a conductive wire, such as, for example, a steel wire.

Returning to FIG. 1, water heating system 100 can further include a first heating element 108 and a second heating element 110. First and second heating elements 108 and 110 can be attached to an interior of tank 102. For example, heating elements 108 and 110 can be disposed at different heights within tank 102.

Heating elements 108 and 110 can be configured to heat water 103 when energized. As an example, heating elements 108 can 110 can be resistance heating elements which generate heat by resisting an electric current. However, heating elements 108 and 110 can each be any suitable device, structure, or circuit for generating heat to raise the temperature of water 103.

Water heating system 100 can further include temperature sensors 112 and 114. Temperature sensors 112 and 114 can be positioned inside the tank proximate to heating elements 108 and 110. In particular, temperature sensor 112 can be positioned proximate to heating element 108 while temperature sensor 114 can be positioned proximate to 110.

Temperature sensors 112 and 114 can respectively provide a temperature signal describing a temperature in their respective local regions. For example, temperature sensor 112 can provide a temperature signal describing an ambient temperature about sensor 112. As an example, temperature sensors 112 and 114 can be thermistors.

According to an aspect of the present disclosure, anode rod 104 can act as a sacrificial anode to protect the interior of tank 102 from corrosion. In particular, anode rod 104 can suffer galvanic corrosion in place of tank 102. Such galvanic corrosion can generate a galvanic current flowing from anode rod 104 to an electrical ground 118. Electrical ground 118 can be the exterior of the tank 102 which is connected to an earth ground.

The galvanic current can flow from anode rod 104 to electrical ground 118 by way of electrical conductor 120. For example, electrical conductor 120 can be connected to core 106 of anode rod 104. Electrical conductor 120 can be made of any suitable conductive material and can include one or more wires, filters, or other suitable components.

Electrical conductor 120 can allow flow of the galvanic current from anode rod 104 to a resistor configuration 116 connected between anode rod 104 and electrical ground 118. Resistor configuration 116 can resist the flow of the galvanic current.

Resistor configuration 116 can be one or more resistors. For example, resistor configuration 116 can be a single adjustable-resistance resistor. As another example, resistor configuration 116 can be a plurality of resistors in parallel. The plurality of resistors can provide identical resistances or varying resistances.

A total resistance provided by resistor configuration 116 can be adjustable. In particular, water heating system 100 can further include one or more resistance adjusting mechanisms 117. Resistance adjusting mechanism 117 can adjust the resistance provided by resistor configuration 116.

In one embodiment, resistance adjusting mechanism 117 can be operated by a user of the water heater such that the resistance provided by resistor configuration 116 is user-adjustable. As an example, resistance adjusting mechanism 117 can be a knob having a plurality of positions. Each position of the knob can correspond to galvanic current flow through a unique combination of resistors included in resistor configuration 116.

In another embodiment, resistance adjusting mechanism 117 can be controlled by a controller of water heating system 100. For example, the controller can provide control signals or other instructions to resistance adjusting mechanism 117. Resistance adjusting mechanism 117 can adjust a resistance provided by resistor configuration 116 based on the received signals. In one implementation, the controller generates the control signals based on user input received from a user interface.

Figure 3:
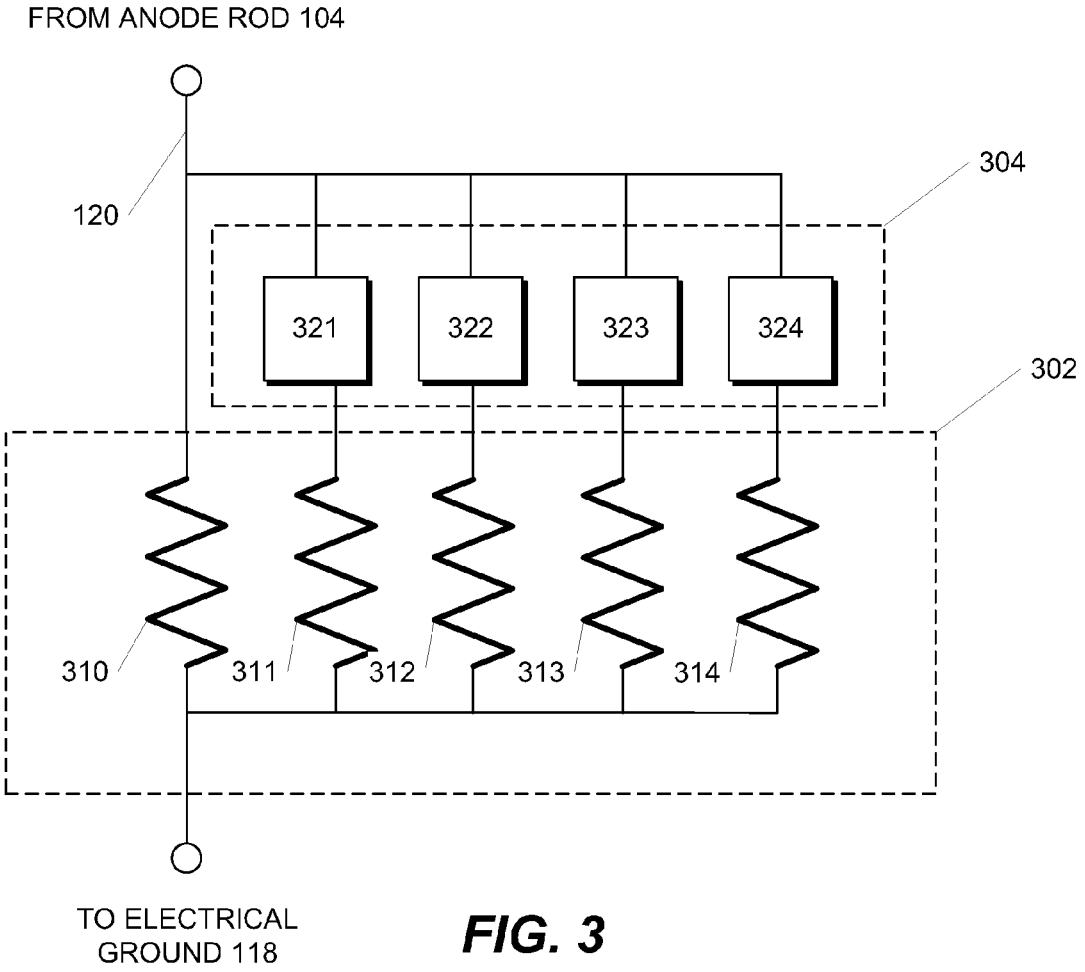
FIG. 3 depicts an exemplary resistor configuration according to an exemplary embodiment of the present disclosure.

As another example, referring now to FIG. 3, an exemplary resistor configuration 302 and exemplary resistance adjusting mechanism 304 according to an exemplary embodiment of the present disclosure are depicted. As shown in FIG. 3, resistor configuration 302 can include a plurality of resistors connected in parallel, including resistors 310-314. A total resistance provided by resistor configuration 302 can be adjusted by adjusting which of resistors 310-314 the galvanic current is permitted to flow through.

Although resistor configuration 302 is depicted in FIG. 3 as including five resistors, the present disclosure is not limited to any particular number or particular configuration of resistors. For example, a more complex network of resistors can be used to provide a large number of potential total resistances from which to select.

Resistors 310-314 can each provide any suitable magnitude of resistance. For example, resistors 310-314 can each provide identical resistances or can provide various resistances. In one implementation, the total resistance provided by resistor configuration 302 can be varied from 1 ohm to 75 ohms. The total resistance can be continuously varied or varied among bands.

Resistance adjusting mechanism 304 can include a plurality of resistance adjusting mechanisms respectively associated with the plurality of resistors, including resistance adjusting mechanisms 321-324. Each of resistance adjusting mechanisms 321-324 can be associated with a particular resistor included in resistor configuration 302. Furthermore, each of resistance adjusting mechanisms 321-324 can selectively allow or disallow flow of the galvanic current through its associated resistor.

For example, resistance adjusting mechanism 321 can selectively allow or disallow flow of galvanic current through its associated resistor 311. As an example, resistance adjusting mechanism 321 can have a first position allowing flow of galvanic current through resistor 311 and a second position disallowing flow through resistor 311. In particular, the first position of resistance adjusting mechanism 321 can electrically connect resistor 311 with electrical conductor 120 while the second position of resistance adjusting mechanism 321 can disconnect or not connect resistor 311 with electrical conductor 120.

Resistance adjusting mechanisms 321-324 can be any suitable device or circuit for respectively controlling galvanic current flow through respective resistors 311-314. Exemplary resistance adjusting mechanisms include, without limitation, jumpers, switches, dip switches, selector switches, resistor plugs, relays, or other suitable devices or circuits.

In some implementations, resistance adjusting mechanisms 321-324 can be accessible and operable by a user. For example, a user can actuate each of resistance adjusting mechanisms 321-324 from a first position to a second position so as to selectively allow or disallow flow of the galvanic current through the associated resistor.

In other implementations, resistance adjusting mechanisms 321-324 can operate, respond to, or be manipulated by control signals provided by a controller. For example, resistance adjusting mechanisms 321-324 can correspond to insulated gate bipolar transistors that respectively allow or disallow flow of galvanic current based on a respective control signals.

As shown in FIG. 3, in some implementations, at least one resistor of resistor configuration 116 can be independent from adjustment (i.e. not have an associated resistance adjusting mechanism). For example, resistor 302 can be a base resistor through which galvanic current always flows. In such fashion, the water heating system 100 can be protected against a complete shut off of anode rod 104's sacrificial functionality accidentally occurring. However, a base resistor is not necessary to practice the invention.

Returning to FIG. 1, water heating system 100 can further include a probe 122 positioned inside tank 102 and in contact with water 103. For example, probe 122 can be a silver chloride electrode probe.

Probe 122 can be configured to provide a feedback signal describing one or more electrical attributes of water 103. For example, probe 122 can provide a feedback signal describing a resistivity of water 103, a conductivity of water 103, or a voltage between probe 122 and tank 102 (i.e. a potential across water 103).

One of skill in the art will appreciate that many components of water heating system 100 have been omitted from FIG. 1 in order to simplify the system for illustration and presentation. For example, water heating system 100 can include a water inlet pipe, a water exit pipe, a dip tube, one or more valves, a flow meter, a mixer, power source components, or any other suitable components necessary or desirable for water heater operation.

Figure 4:
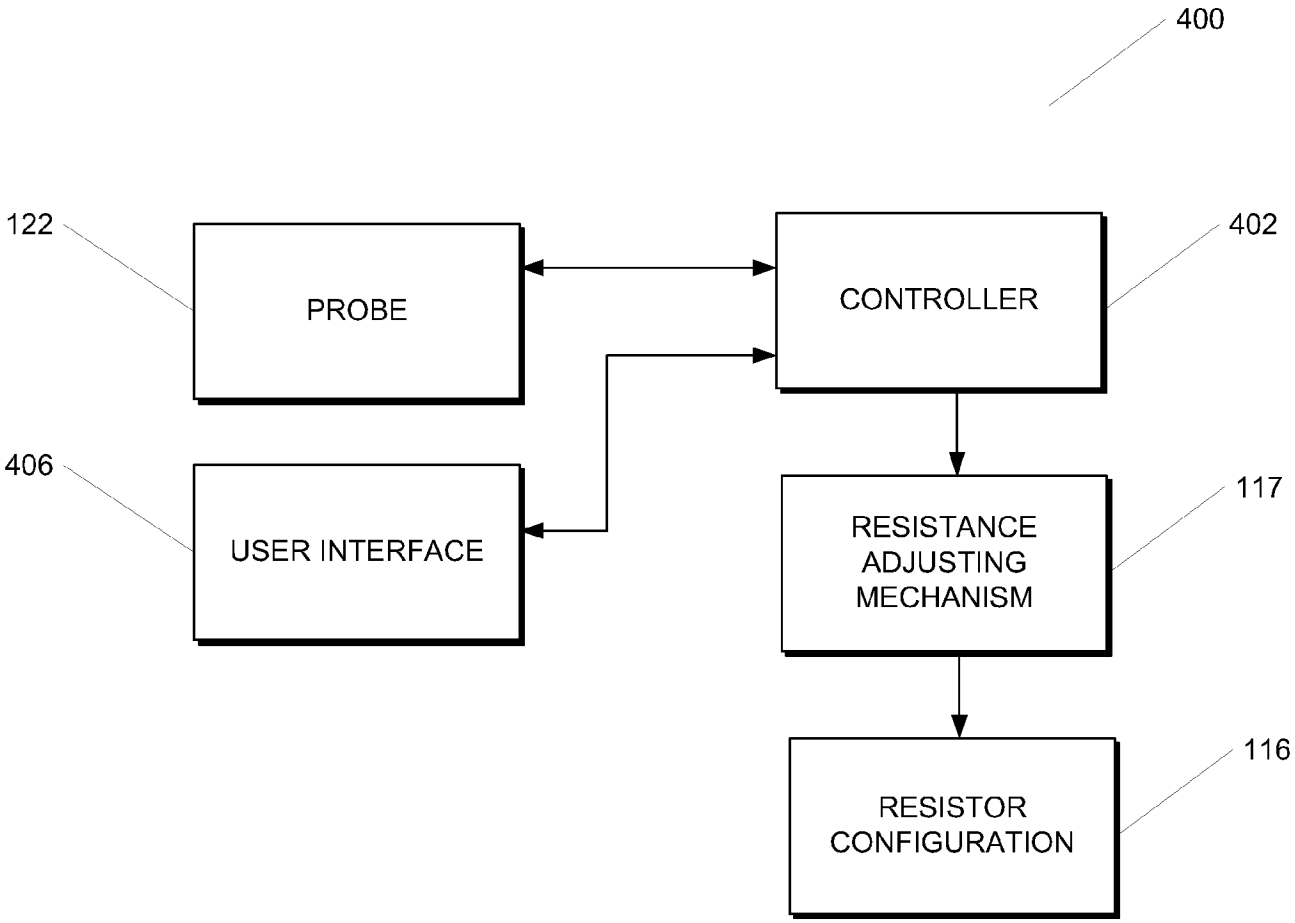
FIG. 4 depicts an exemplary water heater control system according to an exemplary embodiment of the present disclosure.

FIG. 4 depicts an exemplary water heater control system 400 according to an exemplary embodiment of the present disclosure. In particular, control system 400 can include a controller 402.

Controller 402 can be any suitable computing device and can include one or more processors, a memory, or other suitable components. In particular, the memory can store computer-readable instructions that are executed by the processor in order to perform one or more algorithms. In some implementations, controller 402 is an application specific integrated circuit.

Controller 402 can send and receive signals with probe 122 and a user interface 406. For example, probe 122 can provide controller 402 with a feedback signal describing one or more electrical attributes of water stored in the water heater. Probe 122 can continuously provide the feedback signal to controller 402 or probe 122 can be queried, read, or prompted at specific instances by controller 402.

Controller 402 can also receive user-generated instructions from user interface 406. User interface 406 can be any suitable device or components for collecting information from a user and/or sending and receiving information from controller 402, including, for example, a touch-sensitive device implemented using a memory, processor, and embedded firmware.

As another example, user interface 406 can include a plurality of user-selectable indicators that respectively correspond to each of a plurality of resistors. Each indicator can have an LED light that indicates whether such selector is currently selected or not selected.

In one implementation, a user can provide input to the user interface with respect to a desired change in galvanic corrosion or current. Such input can specifically designate a desired resistance to be provided by a resistor configuration or can generally indicate that an increase or decrease is desired.

Controller 402 can also provide a plurality of indications or messages to a user interface 406. For example, user interface 406 can include a display. Controller 402 can send a message to user interface 406 for presentation on the display.

Controller 402 can provide control signals to resistance adjusting mechanism 117 based on one or more of the signals received from probe 122 and user interface 406. As an example, controller 402 can implement algorithms in order to continually or periodically adjust a resistance provided by resistor configuration 116 such that a desired or optimized galvanic current is maintained. In particular, controller 402 can provide control signals or other instructions to resistance adjusting mechanism 117 in order to adjust the resistance provided by resistor configuration 116.

Figure 5:
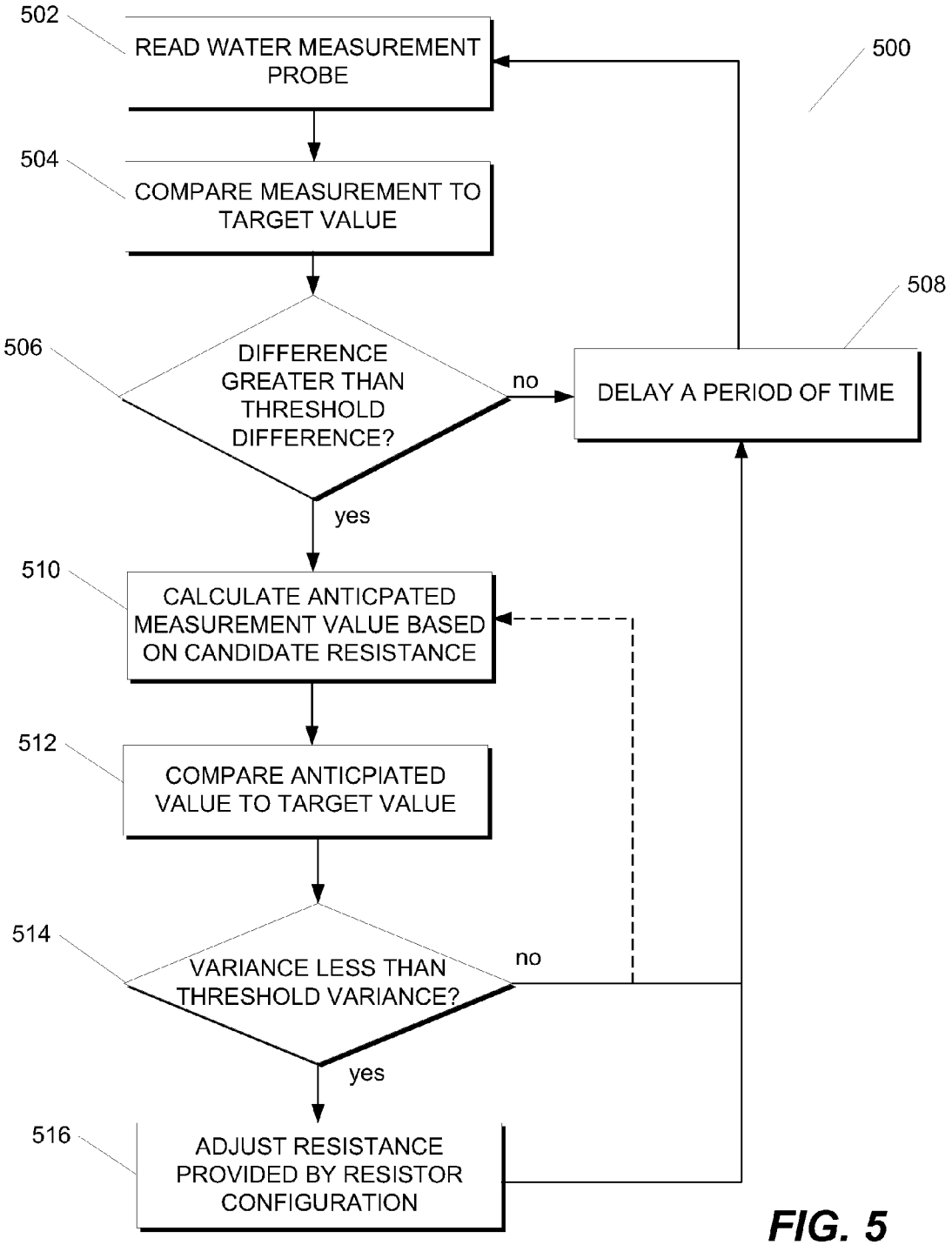
FIG. 5 depicts a flowchart of an exemplary method of operating a water heater according to an exemplary embodiment of the present disclosure.

FIG. 5 depicts a flowchart of an exemplary method (500) of operating a water heater according to an exemplary embodiment of the present disclosure. While exemplary method (500) will be discussed with reference to exemplary water heating system 100 of FIG. 1 and exemplary control system 400 of FIG. 4, method (500) can be implemented using any suitable water heater control system. In addition, although FIG. 5 depicts steps performed in a particular order for purposes of illustration and discussion, methods of the present disclosure are not limited to such particular order or arrangement. One skilled in the art, using the disclosures provided herein, will appreciate that various steps of the method (500) can be omitted, rearranged, combined, and/or adapted in various ways without deviating from the scope of the present disclosure.

At (502) a water measurement probe can be read. For example, controller 402 can sample, read, or request a measurement value of a feedback signal provided by probe 122. The feedback signal can describe one or more electrical attributes of the water stored in the water heater.

At (504) the measurement value is compared to a target value in order to obtain a difference. The target value can be stored in memory and be associated with an optimized magnitude of galvanic current or galvanic corrosion. For example, controller 402 can compare the measurement value and the target value to obtain a difference.

The target value can be predetermined based on the materials of the water heater and stored in memory. Alternatively or in addition, the target value can be manually updated. As another example, self-learning or self-calibration algorithms can be employed in order to refine the target value based on feedback.

At (506) it is determined whether the difference obtained at (504) is greater than a threshold difference. The threshold difference can be stored in memory. For example, controller 402 can determine whether the difference obtained at (504) is greater than the threshold difference.

If it is determined at (506) that the difference obtained at (504) is not greater than the threshold difference, then at (508) a delay can be observed for a period of time. Following the delay at (508), the method (500) can return to (502) and read another measurement value.

However, if it is determined at (506) that the difference obtained at (504) is greater than the threshold difference, then at (510) an anticipated measurement value can be calculated based on a candidate resistance. For example, the candidate resistance can be an increased or decreased resistance with respect to a prevailing resistance provided by resistor configuration 110. The candidate resistance can be determined according to a look up table, step table, mathematical algorithm, or other suitable method.

Controller 402 can calculate the anticipated measurement value based on the candidate resistance. In particular, one or more algorithms can be implemented by controller 402 in order to compute the anticipated measurement. Such algorithms can use stored or learned knowledge of system parameters, water attributes, error tolerances, and other information in order to generate the anticipated measurement. Such algorithms can be manually updated or can use self-learning or self-calibration in order to refine the calculation of anticipated measurements.

At (512) the anticipated measurement value is compared to the target value in order to obtain a variance. The target value can be stored in memory and correspond to an optimized magnitude of galvanic current or galvanic corrosion. For example, controller 402 can compare the anticipated measurement value and the target value to obtain a variance.

At (514) it is determined whether the variance obtained at (512) is less than a threshold variance. The threshold variance can be stored in memory. For example, controller 402 can determine whether the variance obtained at (512) is less than the threshold variance.

If it is determined at (514) that the variance obtained at (512) is not less than the threshold variance, then method (500) can proceed to (508) and a delay can be observed for a period of time. Following the delay at (508), the method (500) can return to (502) and read another measurement value.

Alternatively, if it is determined at (514) that the variance obtained at (512) is not less than the threshold variance, then method (500) can return to (510) and a second anticipated measurement value can be calculated based on a second candidate resistance. In particular, the second candidate resistance can represent a refined guess at the magnitude of resistance that will result in the desired galvanic current or galvanic corrosion.

However, if it is determined at (514) that the variance obtained at (512) is less than the threshold variance, then at (518) a resistance provided by a resistor configuration can be adjusted to the candidate resistance used at (510). For example, controller 402 can send one or more control signals to resistance adjusting mechanism 117. Based on the received signals, resistance adjusting mechanism 117 can adjust the resistance provided by resistor configuration 116 to the candidate resistance.

After step (514), method (500) can return to step (508), delay a period of time, and then begin method (500) again at (502). In such fashion, the resistance provided by resistor configuration 116 can be periodically or continuously adjusted in order to maintain an optimized galvanic current flow. In particular, prevailing electrical attributes of the water included in the water heater can be used to maintain the proper magnitude of resistance. Therefore, the tank of the water heater can be protected from corrosion while undesirable byproducts are minimized.

Figure 6:
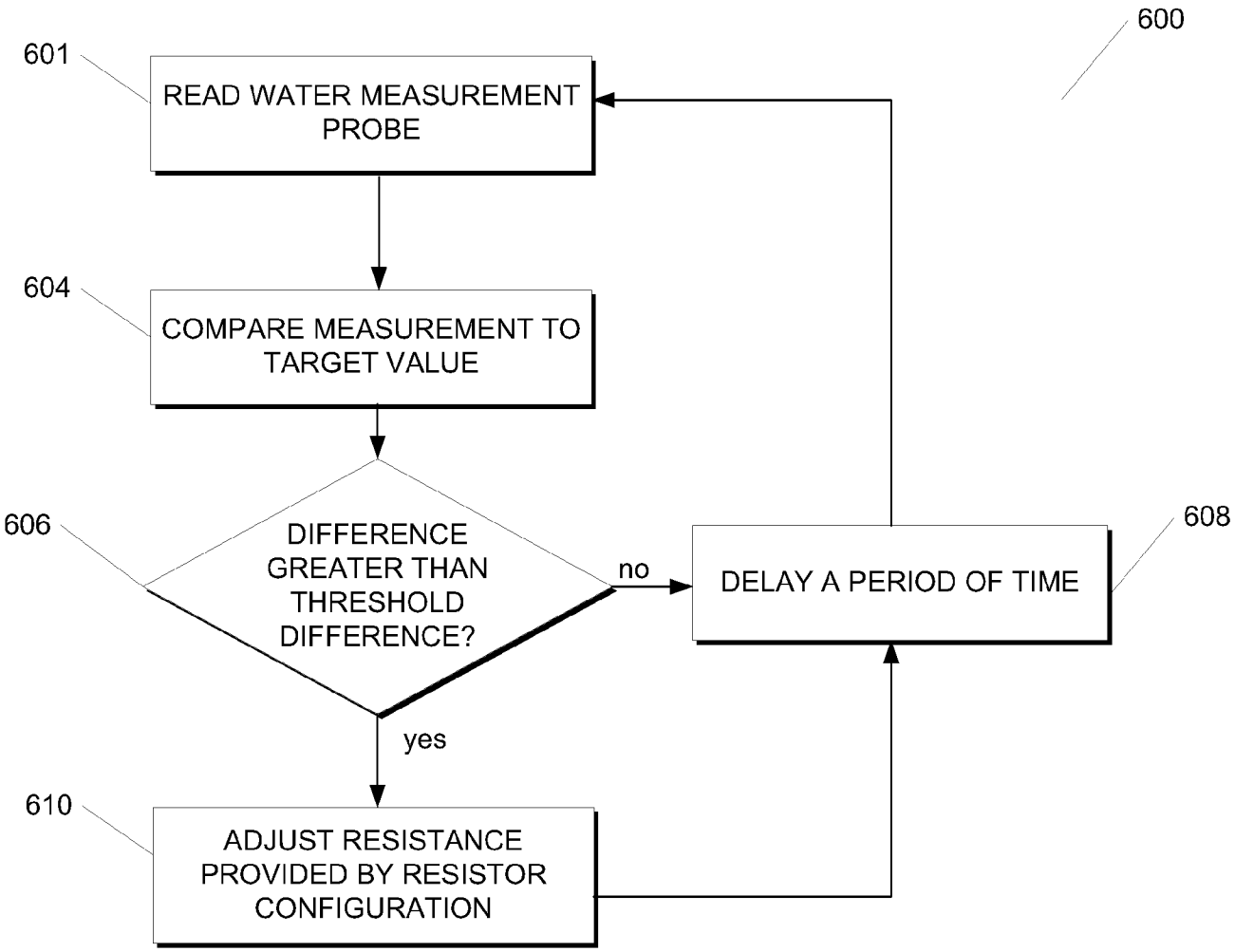
FIG. 6 depicts a flowchart of an exemplary method of operating a water heater according to an exemplary embodiment of the present disclosure.

FIG. 6 depicts a flowchart of an exemplary method (600) of operating a water heater according to an exemplary embodiment of the present disclosure. While exemplary method (600) will be discussed with reference to exemplary water heating system 100 of FIG. 1 and exemplary control system 400 of FIG. 4, method (600) can be implemented using any suitable water heater control system. In addition, although FIG. 6 depicts steps performed in a particular order for purposes of illustration and discussion, methods of the present disclosure are not limited to such particular order or arrangement. One skilled in the art, using the disclosures provided herein, will appreciate that various steps of the method (600) can be omitted, rearranged, combined, and/or adapted in various ways without deviating from the scope of the present disclosure.

At (602) a water measurement probe can be read. For example, controller 402 can sample, read, or request a measurement value of a feedback signal provided by probe 122. The feedback signal can describe one or more electrical attributes of the water stored in the water heater.

At (604) the measurement value is compared to a target value in order to obtain a difference. The target value can be stored in memory and correspond to an optimized magnitude of galvanic current or galvanic corrosion. For example, controller 402 can compare the measurement value and the target value to obtain a difference.

The target value can be predetermined based on the materials of the water heater and stored in memory. Alternatively or in addition, the target value can be manually updated. As another example, self-learning or self-calibration algorithms can be employed in order to refine the target value based on feedback.

At (606) it is determined whether the difference obtained at (604) is greater than a threshold difference. The threshold difference can be stored in memory. For example, controller 402 can determine whether the difference obtained at (604) is greater than the threshold difference.

If it is determined at (606) that the difference obtained at (604) is not greater than the threshold difference, then at (608) a delay can be observed for a period of time. Following the delay at (608), method (600) can return to (602) and read another measurement value.

However, if it is determined at (606) that the difference obtained at (604) is greater than the threshold difference, then at (610) a resistance provided by a resistor configuration can be adjusted. For example, controller 402 can send one or more control signals to resistance adjusting mechanism 117 instructing that the resistor configuration 116 be adjusted to a new resistance. The new resistance to which resistor configuration 116 is adjusted can be determined according to a look up table, a step table, a mathematical algorithm, or any other suitable method. For example, based on whether the measurement value is higher or lower than the target value, the prevailing resistance provided by resistor configuration 116 can either be incremented or decremented according to a given increment in order to obtain the new resistance. Based on the received signals, resistance adjusting mechanism 117 can adjust the resistance provided by resistor configuration 116.

After step (610), method (600) can return to step (608), delay a period of time, and then begin method (600) again at (602). In such fashion, the resistance provided by resistor configuration 116 can be periodically or continuously adjusted in order to maintain an optimized galvanic current flow. In particular, prevailing electrical attributes of the water included in the water heater can be used to maintain the proper magnitude of resistance. Therefore, the tank of the water heater can be protected from corrosion while undesirable byproducts are minimized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a water heater, the method comprising:

connecting one or more resistors between an anode rod extending into a volume of water stored by the water heater and an electrical ground such that a galvanic current flows from the anode rod through the one or more resistors to the electrical ground;

receiving a feedback signal describing one or more electrical attributes of the volume of water stored in the water heater;

after receiving the feedback signal determining a difference between the feedback signal and a target value; and after determining the difference, adjusting a resistance provided by the one or more resistors based on the feedback signal such that the galvanic current is either increased or decreased;

wherein adjusting the resistance provided by the one or more resistors comprises adjusting the resistance provided by the one or more resistors when the difference is greater than threshold difference.

2. The method of claim 1, wherein receiving a feedback signal describing one or more electrical attributes of a volume of water comprises receiving the feedback signal from a water measurement probe, the feedback signal describing a water resistivity.

3. The method of claim 1, wherein receiving a feedback signal describing one or more electrical attributes of a volume of water comprises receiving the feedback signal from a water measurement probe, the feedback signal describing a water conductivity.

4. The method of claim 1, wherein receiving a feedback signal describing one or more electrical attributes of a volume of water comprises receiving the feedback signal from a water measurement probe, the feedback signal describing a potential between the water measurement probe and a tank of the water heater.

5. The method of claim 1, further comprising, prior to adjusting the resistance but after determining a difference between the feedback signal and the target value:

calculating an anticipated value of the one or more electrical attributes based on the feedback signal and a candidate resistance; and determining a variance between the anticipated value and the target value;

wherein adjusting the resistance provided by the one or more resistors when the difference is greater than a threshold difference comprises adjusting the resistance provided by the one or more resistors to the candidate resistance when the difference is greater than the threshold difference and the variance is less than a threshold variance.

6. A method of operating a water heater that includes a tank for holding a volume of water, an anode rod that extends into the volume of water, and a resistor configuration connected in a path of galvanic current flow between the anode rod and an electrical ground, the resistor configuration providing a variable resistance, the method comprising:

receiving, by a controller, a feedback signal from a probe positioned within the tank of the water heater, the feedback signal descriptive of one or more electrical attributes of the volume of water held in the tank;

adjusting, by the controller based at least in part on the feedback signal, the variable resistance provided by the resistor configuration to adjust a magnitude of the galvanic current flow between the anode rod and the electrical ground;

wherein adjusting, by the controller, the variable resistance provided by the resistor configuration comprises providing by the controller, one or more control signals to a resistance adjusting mechanism to adjust the variable resistance provided by the resistor configuration; and wherein providing, by the control the one or more control sign is comprise causing, by the controller, actuation of at least one of a plurality of jumpers respectively associated with a plurality of resistors, the plurality of resistors in parallel, each of the plurality of jumpers selectively allowing or disallowing flow of the galvanic current though the associated resistor.

7. The method of claim 6, wherein receiving, by the controller, the feedback signal from the probe comprises receiving the feedback signal that describes a water resistivity of the volume of water.

8. The method of claim 6, wherein receiving, by the controller, the feedback signal from the probe comprises receiving the feedback signal that describes a water conductivity of the volume of water.

9. The method of claim 6, wherein receiving, by the controller, the feedback signal from the probe comprises receiving the feedback signal that describes a voltage potential between the probe and the tank of the water heater.

10. The method of claim 6, further comprising:

comparing, by the controller, a measurement value included in the feedback signal to a target value;

wherein adjusting, by the controller based at least in part on the feedback signal, the variable resistance provided by the resistor configuration comprises adjusting, by the controller, the variable resistance provided by the resistor configuration based at least in part on the comparison of the measurement value to the target value.

11. The method of claim 10, wherein adjusting, by the controller, the variable resistance provided by the resistor configuration based at least in part on the comparison of the measurement value to the target value comprises:

when a difference between the measurement value and the target value is greater than a threshold value, adjusting, by the controller, the variable resistance provided by the resistor configuration; and when the difference between the measurement value and the target value is not greater than the threshold value:

delaying, by the controller, for a period of time; and after delaying for the period of time, obtaining, by the controller, an additional measurement value to compare to the target value.

12. The method of claim 6, wherein adjusting, by the controller based at least in part on the feedback signal, the variable resistance provided by the resistor configuration comprises:

calculating, by the controller based on the feedback signal, an anticipated value of the one or more electrical attributes for a candidate resistance;

determining, by the controller, a variance between the anticipated value and a target value; and adjusting, by the controller, the variable resistance provided by the resistor configuration to the candidate resistance when the variance is less than a threshold variance.

13. A method of operating a water heater that includes a tank for holding a volume of water, an anode rod that extends into the volume of water, and a resistor configuration connected in a path of galvanic current flow between the anode rod and an electrical ground, the resistor configuration providing a variable resistance, the method comprising:

receiving, by a controller, a feedback signal from a probe positioned within the tank of the water heater, the feedback signal descriptive of one or more electrical attributes of the volume of water held in the tank;

adjusting, by the controller based at least in part on the feedback signal, the variable resistance provided by the resistor configuration to adjust a magnitude of the galvanic current flow between the anode rod and the electrical ground;

wherein adjusting, by the controller based at least in part on the feedback signal, the variable resistance provided by the resistor configuration comprises:

calculating, by the controller based on the feedback signal, an anticipated value of the one or more electrical attributes for a candidate resistance;

determining, by the controller, a variance between the anticipated value and a target value; and adjusting, by the controller, the variable resistance provided by the resistor configuration to the candidate resistance when the variance is less than a threshold variance.

14. The method of claim 13, wherein receiving, by the controller, the feedback signal from the probe comprises receiving the feedback signal that describes a water resistivity of the volume of water.

15. The method of claim 13, wherein receiving, by the controller, the feedback signal from the probe comprises receiving the feedback signal that describes a water conductivity of the volume of water.

16. The method of claim 13, wherein receiving, by the controller, the feedback signal from the probe comprises receiving the feedback signal that describes a voltage potential between the probe and the tank of the water heater.

17. The method of claim 13, wherein adjusting, by the controller, the variable resistance provided by the resistor configuration comprises providing, by the controller, one or more control signals to a resistance adjusting mechanism to adjust the variable resistance provided by the resistor configuration.

18. The method of claim 17, wherein providing, by the controller, the one or more control signals comprises causing, by the controller, actuation of at least one of a plurality of switching devices respectively associated with a plurality of resistors, the plurality of resistors in parallel, each of the plurality of switching devices selectively allowing or disallowing flow of the galvanic current though the associated resistor.

* * * * *